US005960232A

United States Patent [19]

Cheng

[11] Patent Number: 5,960,232

[45] Date of Patent: Sep. 28, 1999

[54] METHOD FOR CONTROLLING DENSITY IN A PRINTED IMAGE

[75] Inventor: Kuangti Ted Cheng, Beaverton, Oreg.

[73] Assignee: Tektronix, Inc, Wilsonville, Oreg.

[21] Appl. No.: 08/982,715

[22] Filed: Dec. 2, 1997

[51] Int. Cl.[6] ..... G03G 15/08

[52] U.S. Cl. ..... 399/55; 399/270; 399/285

[58] Field of Search ..... 399/55, 53, 54, 399/270, 285, 49, 60, 64

[56] References Cited

U.S. PATENT DOCUMENTS

| | | | |
|---|---|---|---|
| 4,801,980 | 1/1989 | Arai et al. | 355/14 D |
| 4,833,506 | 5/1989 | Kuru et al. | 355/208 |
| 4,974,024 | 11/1990 | Bares et al. | 355/246 |
| 5,160,966 | 11/1992 | Shiina et al. | 355/206 |
| 5,204,699 | 4/1993 | Birnbaum et al. | 346/160 |
| 5,576,824 | 11/1996 | Folkins | 355/327 |
| 5,635,972 | 6/1997 | Maruyama et al. | 347/158 |
| 5,673,075 | 9/1997 | Jacobs et al. | 347/131 |
| 5,708,917 | 1/1998 | Kawai et al. | 399/58 |
| 5,708,918 | 1/1998 | Okuno et al. | 399/61 |
| 5,749,023 | 5/1998 | Grace et al. | 399/58 |

*Primary Examiner*—Richard Moses
*Attorney, Agent, or Firm*—Charles F. Moore

[57] ABSTRACT

An improved method for controlling the optical density of an image printed by an electrostatic printer is provided. The method compensates for optical density drift over the useful life of a toner receptacle by adjusting the voltage vector between the photoconductive belt and the toner particles. The method calculates an overall toner usage amount and adjusts the voltage vector when the amount reaches one or more predetermined values. In this manner, the present method controls the optical density of a printed image over the useful life of the toner receptacle.

10 Claims, 4 Drawing Sheets

METHOD FOR CONTROLLING DENSITY IN A PRINTED IMAGE

FIELD OF INVENTION

This invention relates generally to electrostatic imaging and, more specifically, to a method of controlling the optical density of an image formed by an electrostatic imaging apparatus.

BACKGROUND OF INVENTION

In electrostatic printing a latent image is formed by scanning a laser or light from an LED (light emitting diode) on a continuous receiving surface, such as a photoconductive belt or drum. The receiving surface is first charged with a uniform negative or positive charge, and where the light strikes the surface the charge is conducted away, leaving the latent image. The image is then developed by the electrical attraction of toner particles to the latent image areas on the photoconductive surface.

In electrostatic imaging devices the toner particles are often contained in and supplied through replaceable cartridges. For color printing, several colors of toner, such as cyan, magenta, yellow and black, are utilized to create the desired color gamut. Each color is typically contained in a separate cartridge. Mono-component contact development refers to the use of a single type of toner particle, as opposed to dual-component development which uses carrier particles and toner particles that are mixed together prior to contact with the belt.

In mono-component contact development, the size of the individual toner particles in a given cartridge typically varies. As the smaller particles have a lower mass and a higher charge per mass, they are more easily attracted to the photoconductive surface and are generally developed first at the beginning of the life of the cartridge. As the smaller particles are depleted over time, the larger toner particles are used more toward the end of the useful life of the cartridge. This causes a density shift in the developed image over the life of the toner cartridge, as the large particles tend to create a darker image. Also, as the usage of a toner cartridge increases, the charge control agent in the toner is depleted and the particles attain a lower electrical charge. This results in a greater number of toner particles being developed for a given latent image, thereby further darkening the developed image. In some cases the optical density of a printed image can increase 20% to 30% from the beginning of a new developer cartridge to the end of its useful life. In color printing, this density shift can cause a major change in the color tone of a composite image, such as when one of four color toner cartridges is replaced with a new cartridge.

In the prior art, separate toner development sensors in the printing apparatus have been utilized in an attempt to control image density. These components add unwanted cost and complexity to the apparatus and generally give poor results. The present invention seeks to overcome the shortcomings of the prior art by providing a reliable method for controlling image density that eliminates the need for additional sensory and logic components.

SUMMARY OF THE INVENTION

It is an aspect of the present invention to provide an improved method of controlling optical density of an image formed by an electrostatic image forming apparatus.

It is another aspect of the present invention that the method compensates for density drift over the useful life of a replaceable toner cartridge.

It is a feature of the present invention that the method adjusts the voltage difference between the developer roller and the imaged areas of the photoconductive surface to control the optical density of a printed image.

It is another feature of the present invention that the method calculates an overall toner usage amount to determine when to adjust the voltage difference.

It is an advantage of the present invention that the method does not require additional sensing or detecting components to control optical density.

It is another advantage of the present invention that the method utilizes a simple four-step look up table to control the voltage difference adjustments.

To achieve the foregoing and other aspects, features and advantages, and in accordance with the purposes of the present invention as described herein, an improved method for controlling the optical density of an image printed by an electrostatic printer is provided. The method compensates for density drift over the useful life of a toner receptacle by adjusting the voltage difference between the imaged and non-imaged areas on the photoconductive belt and the toner developer roller. The method calculates an overall toner usage amount and adjusts the voltage difference when the amount reaches one or more predetermined values. In this manner, the present method controls the optical density of a printed image over the useful life of the toner receptacle.

Still other aspects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modifications in various, obvious aspects all without departing from the invention. Accordingly, the drawings and descriptions will be regarded as illustrative in nature and not as restrictive. And now for a brief description of the drawings.

DETAILED DESCRIPTION OF THE PREFERRED EMBODIMENT

Figure 1:
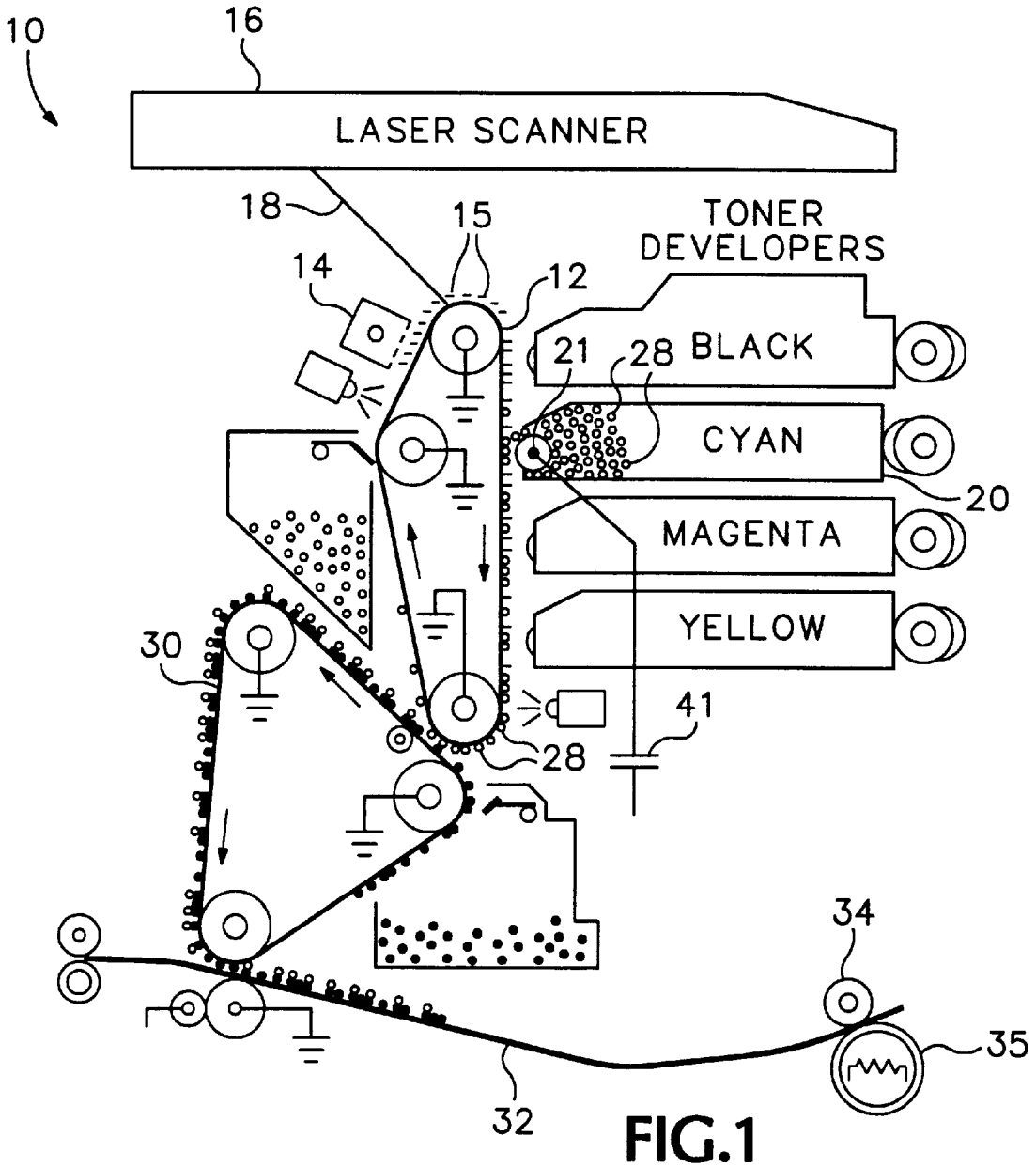
FIG. 1 is a schematic diagram of a portion of an electrostatic printer that utilizes the method for controlling image density of the present invention.

FIG. 1 is a schematic illustration of an imaging portion of an electrostatic color image forming apparatus 10 that utilizes the method of controlling image density of the present invention. An example of an electrostatic imaging apparatus is disclosed in U.S. Pat. No. 5,576,824 (the '824 patent) entitled FIVE CYCLE IMAGE ON IMAGE PRINTING ARCHITECTURE. The '824 patent is hereby specifically incorporated by reference in pertinent part. The following description of a preferred embodiment of the method of the present invention refers to its use in this type of color printing apparatus. It will be appreciated, however, that the method of the present invention may be used with electrostatic monochrome imaging apparatus and various other electrostatic imaging apparatus that utilize different architectures, such as photocopiers. Accordingly, the following description will be regarded as merely illustrative of one embodiment of the present invention.

With continued reference to FIG. 1, the imaging apparatus 10 includes an image receiving surface in the form of an endless photoconductive belt 12. A corona charging device or corotron charger 14 is positioned adjacent to the belt 12 and coupled to a negative high voltage source (not shown). The corotron charger 14 imparts a bias voltage in the form of a uniform negative charge on the belt 12 in preparation for imaging, with the negative charges being indicated by reference numeral 15 in FIG. 1.

To expose an image on the belt 12, a laser scanner 16 scans an imaging beam 18 across the surface of the belt 12. The negative electrical charges 15 on the belt 12 are selectively dissipated as the imaging beam 18 scans across the belt to form the latent electrostatic image. To develop the image on the belt 12, a toner cartridge, such as the cyan cartridge 20 in FIG. 1, is moved into operative contact with the belt 12 downstream of the exposure point. The cartridge 20 contains a developer roller 21 that contacts the belt 12 to selectively transfer toner particles 28 to the belt. The developer roller 21 is negatively charged by a voltage source 41, with the toner particles 28 in the cartridge 20 attaining the voltage of the developer roller.

Charging the developer roller 21 creates voltage differences or vectors between the developer roller and the imaged and non-imaged areas on the belt 12. The voltage differences attract toner particles 28 to the latent image areas on the belt 12 and repel toner particles from the non-imaged areas. In one embodiment, the developer roller is given a default voltage of approximately −160 Volts, the imaged areas on the belt 12 have an imaged voltage of approximately −10 Volts and the non-imaged areas have a non-imaged voltage of approximately −500 Volts. In this manner, a development voltage vector $V_D$ between an imaged area and the developer roller 21 is $V_D$=−10 V−(−160 V)=+150 V, thereby attracting the toner particles 28 to the imaged area. Conversely, a white voltage vector $V_W$ between a non-imaged area and the developer roller 21 is $V_W$=−500 V−(−160 V)=−340 V, thereby repelling the toner particles 28 from the non-imaged area. It will be appreciated that the force of attraction between the toner particles 28 and the imaged areas on the belt 12 is directly proportional to the magnitude of the development voltage vector. Additionally, the density of a printed image increases as the mass of the toner particles 28 attracted to the belt 12 increases, and vice versa.

The toner particles 28 that are transferred to the photoconductive belt 12 to form a portion of the latent image are then transferred from the photoconductive belt to an accumulator belt 30. The above imaging process is repeated for the other three toner cartridges to create a complete color image on the accumulator belt 30. The complete image is then transferred from the accumulator belt 30 to a final receiving medium 32, such as paper. The image is then fixed to the final receiving medium 32 by passing the medium through a nip created by a pair of fuser rollers 34, 35.

Figure 2:
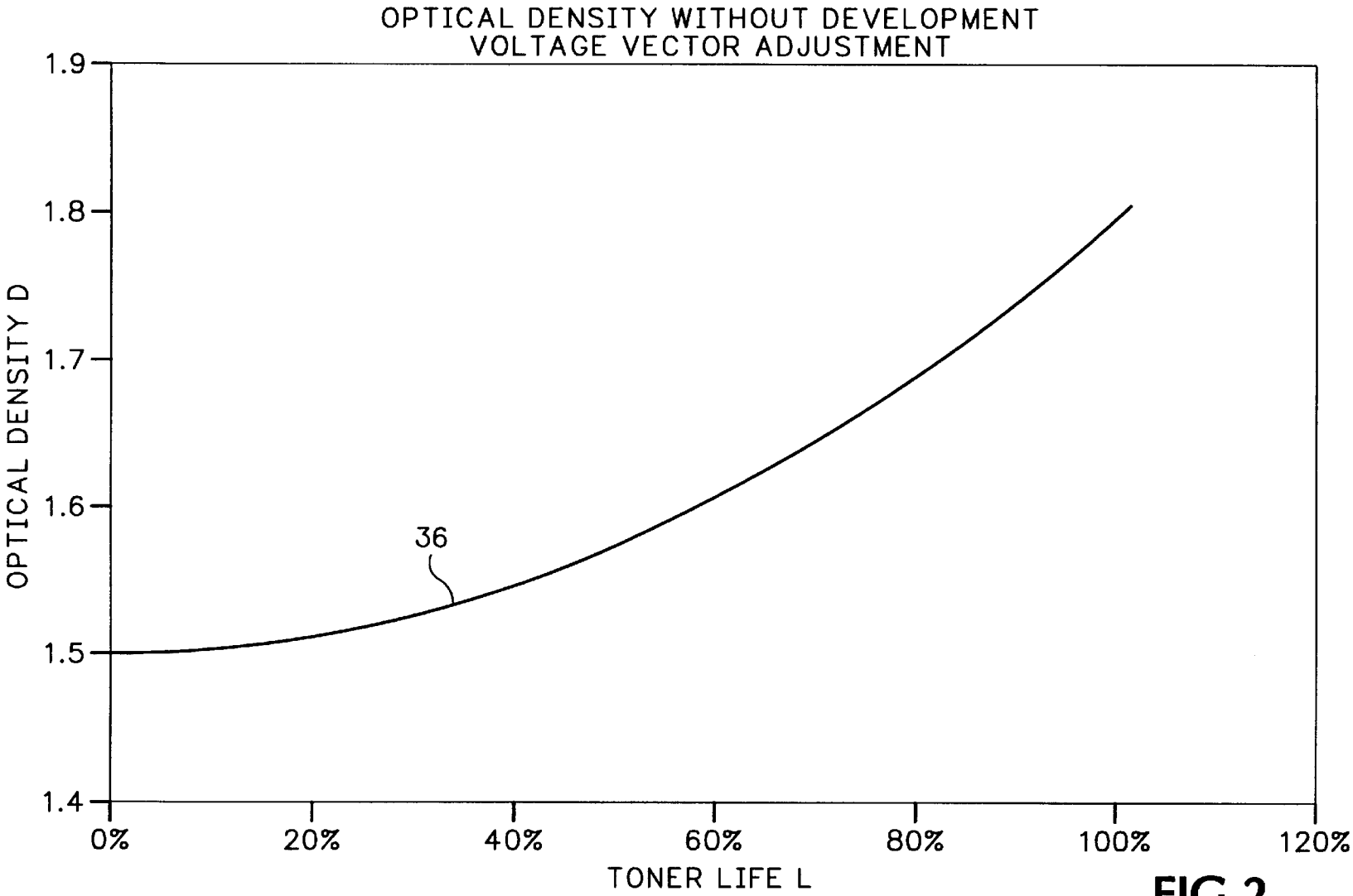
FIG. 2 is a graphical representation of the increase in optical density of an image over the life of a toner cartridge.

With reference now to FIG. 2, line 36 illustrates an example of the increase in optical density D of an imaged printed at a constant developer roller voltage over the life L of a toner cartridge. Optical density D is defined by the equation $D=-\log_{10}X$, where X is the percentage of light that is reflected by the image. In the example illustrated in FIG. 2, the optical density D of an image at the beginning of toner cartridge life L (0% L) is approximately 1.5 and at the end of life L (100% L) is approximately 1.8, corresponding to a 20% increase in optical density. As explained above, this increase is caused by the variation in size and charge of the toner particles 28, and more specifically by the use of particles having a greater mass and lower charge to form the image toward the end of the useful life L of a toner cartridge.

Figure 3:
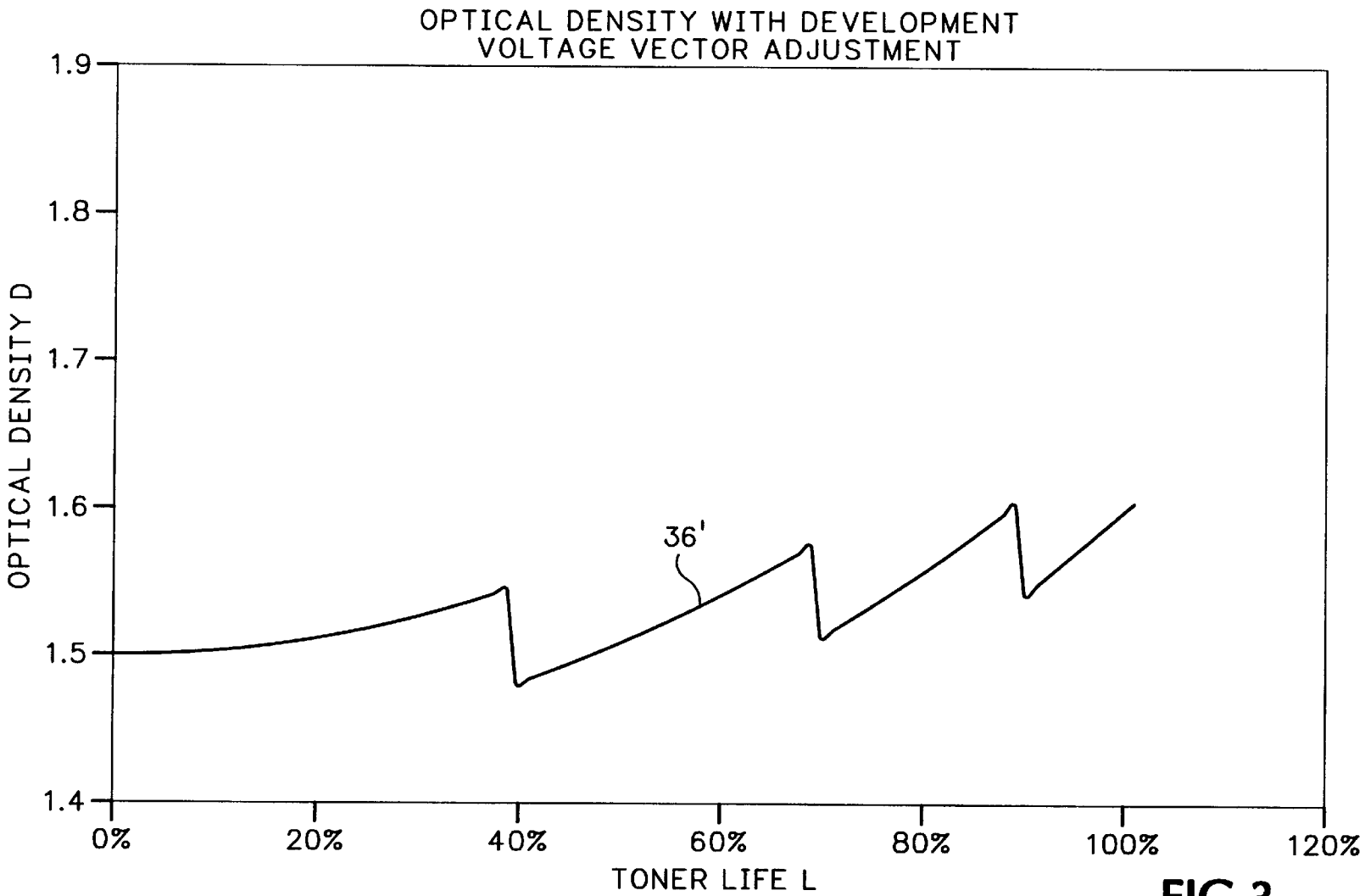
FIG. 3 is a graphical representation of the adjusted optical density of an image over the life of a toner cartridge, the optical density being controlled by periodic adjustments to the developer roller bias voltage.
Figure 4:
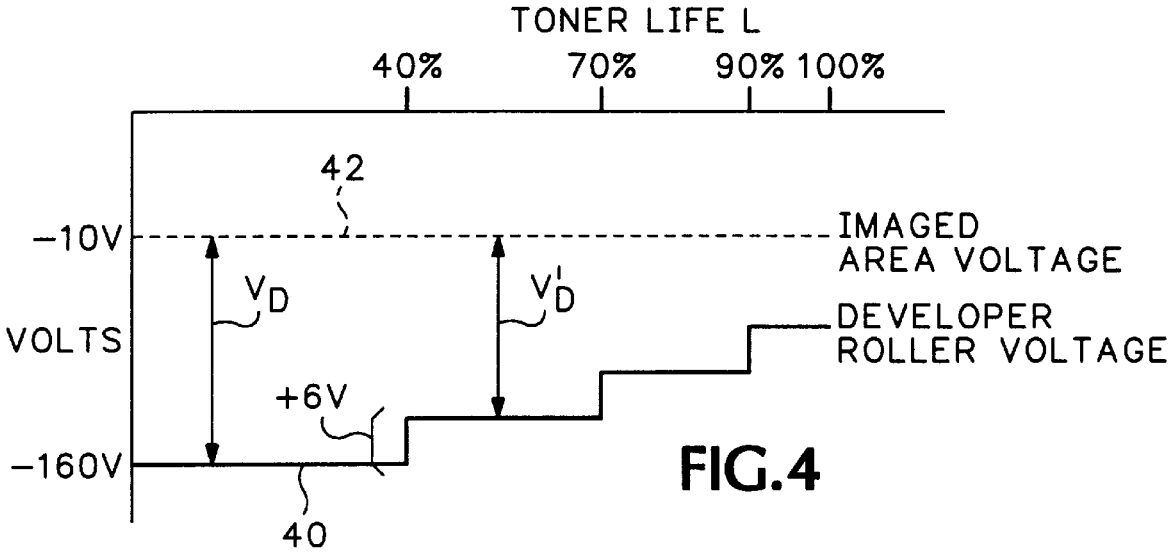
FIG. 4 is a graphical representation of the adjustments to the developer roller bias voltage over the life of the toner cartridge to compensate for the shift in optical image density.

The present invention compensates for the increase in image optical density over the useful life of a toner cartridge by adjusting the development voltage vector $V_D$ at one or more points during the useful life of the cartridge. With reference now to FIGS. 3 and 4, a preferred embodiment of the method of the present invention will now be described. By comparing FIGS. 3 and 4 it will be seen that by increasing the developer roller voltage 40 at predetermined points during the toner life L, the optical density 36' is adjusted to be closer to the original beginning density of approximately 1.5 at the beginning of cartridge life L than without adjusting the developer roller voltage (FIG. 2). With reference to FIG. 4, broken line 42 represents the essentially constant voltage of the imaged or discharged areas of the photoconductive belt 12. It follows that by increasing the developer roller voltage 40 at 40% of toner life L from the preferred default developer roller voltage of approximately −160 Volts, the original development voltage vector $V_D$ between the imaged areas of the belt 12 and the developer roller 21 and toner particles 28 is reduced to an adjusted value $V_D'$. This in turn reduces the force of attraction between the toner particles 28 and the imaged areas of the belt 12. Similar reductions in the development voltage vector at 70% and 90% of toner life L further reduce the force of attraction. It follows that the resulting reduced force of attraction will attract fewer toner particles 28 to an imaged area. Advantageously, this principle coupled with the increase in toner particle size and decrease in charge over the life of the cartridge serves to control the optical density of the printed image and reduce its deviation from the original density at the early stages of cartridge life L.

As illustrated in FIG. 4, in the preferred embodiment the developer roller voltage 40 is increased at approximately 40%, 70% and 90% of toner life L. For each increase the preferred magnitude of the increase is 6 V. These preferred adjustment points were chosen to achieve a desired level of image density control with a simple four-step look up table (LUT). It will be appreciated that many variations and arrangements of adjustment points may be utilized to control the image density.

Figure 5:
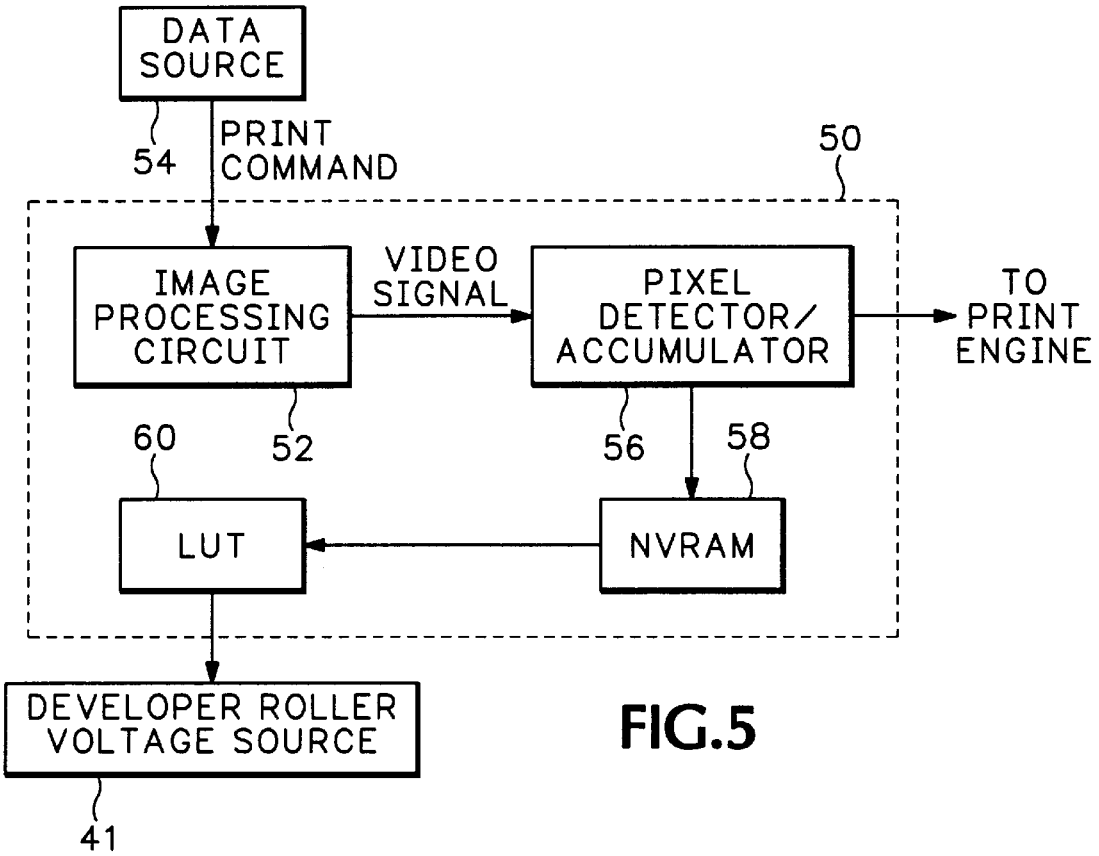
FIG. 5 is a functional block diagram showing a printer controller processing a print command and carrying out the method of the present invention.

To monitor the toner life L of a given cartridge, the preferred embodiment of the present invention utilizes a pixel counting algorithm in the controller of the imaging apparatus. With reference now to FIG. 5, the controller 50 includes an image processing circuit 52 that receives a print command from a data source 54. The image processing circuit 52 sends a video signal to a pixel detector/accuinulator 56 that counts an estimated number of pixels used for each color to print the desired image. This pixel data is provided to a non-volatile memory source (NVRAM) 58 that maintains an overall number of pixels used for each toner cartridge. The estimated number of pixels used for a given color/toner cartridge for the desired image is added to the overall number of pixels used for that cartridge to yield a revised overall number of pixels used. The controller 50 then converts the revised overall number of pixels used to an overall toner usage amount that corresponds to a toner life percentage L. This information is compared to a look up table (LUT) 60 that corresponds to the graphical representation of FIG. 4. Utilizing the LUT 60 the controller 50 controls the developer roller voltage source 41 to adjust the developer roller voltage at the desired points during the toner life L. It will be appreciated that the present invention contemplates and encompasses other methods and apparatus for calculating an overall toner usage amount, such as detecting the amount of toner present on the photoconductive belt 12 or utilizing a sensor to detect the amount of toner remaining in a cartridge.

The foregoing description of a preferred embodiment of the invention has been presented for purposes of illustration and description. It is not intended to be exhaustive or to limit the invention to the precise form disclosed. The terms and expressions which have been employed in the foregoing specification are used therein as terms of description and not of limitation. The use of such terms and expressions is not intended to exclude equivalents of the features shown and described or portions thereof. Many changes, modifications, and variations in the steps and procedures can be made, and the invention may be utilized with various different printing apparatus, other than solid ink offset printers, all without departing from the inventive concepts disclosed herein.

The preferred embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when the claims are interpreted in accordance with breadth to which they are fairly, legally, and equitably entitled. All patents cited herein are incorporated by reference in their entirety.

What is claimed is:

1. A method of controlling optical density of an image formed by an electrostatic image forming apparatus, the image forming apparatus creating a development voltage vector between an image receiving surface and toner particles to attract the toner particles to the image receiving surface and form a latent image thereon, the method comprising the steps of:

calculating an overall toner usage amount; and adjusting the development voltage vector when the overall toner usage amount reaches a first predetermined value, whereby the optical density of the image is controlled.

2. The method of claim 1, wherein the step of calculating an overall toner usage amount further comprises the steps of:

counting an estimated number of pixels used to print the image;

adding the estimated number of pixels used to an overall number of pixels used to yield a revised overall number of pixels used; and converting the revised overall number of pixels used to the overall toner usage amount.

3. The method of claim 2, wherein the step of adjusting the development voltage vector further comprises the step of reducing the development voltage vector by a fixed value when the overall toner usage amount reaches the first predetermined value.

4. The method of claim 3, wherein the toner particles are contained in a receptacle having a maximum toner capacity, and further including the step of setting the first predetermined value to approximately 40% of the maximum toner capacity.

5. The method of claim 4, further including the step of adjusting the development voltage vector when the overall toner usage amount reaches a second predetermined value.

6. The method of claim 5, further including the step of setting the second predetermined value to approximately 70% of the maximum toner capacity.

7. The method of claim 6, further including the step of adjusting the development voltage vector when the overall toner usage amount reaches a third predetermined value.

8. The method of claim 7, further including the step of setting the third predetermined value to approximately 90% of the maximum toner capacity.

9. The method of claim 3, wherein the step of reducing the development voltage vector by the fixed value comprises reducing the development voltage vector by approximately 6 volts.

10. The method of claim 9, further comprising the step of repeating the steps of calculating an overall toner usage amount and adjusting the development voltage vector for each of a plurality of colors of toner particles.

* * * * *